US011548304B2

(12) United States Patent
Nussbaum

(10) Patent No.: US 11,548,304 B2
(45) Date of Patent: Jan. 10, 2023

(54) ECO-FRIENDLY SIGNAGE

(71) Applicant: Green Dot Sign Incorporated, St. Paul, MN (US)

(72) Inventor: Simon Patrick Nussbaum, St. Paul, MN (US)

(73) Assignee: Green Dot Sign Incorporated, St. Paul, MN (US)

( * ) Notice: Subject to any disclaimer, the term of this patent is extended or adjusted under 35 U.S.C. 154(b) by 200 days.

(21) Appl. No.: 16/800,350

(22) Filed: Feb. 25, 2020

(65) Prior Publication Data

US 2020/0269624 A1 Aug. 27, 2020

Related U.S. Application Data

(60) Provisional application No. 62/809,943, filed on Feb. 25, 2019.

(51) Int. Cl.
*B41M 5/00* (2006.01)
*G09F 7/00* (2006.01)

(52) U.S. Cl.
CPC ..... *B41M 5/0017* (2013.01); *B41M 5/0047* (2013.01); *G09F 7/00* (2013.01)

(58) Field of Classification Search
CPC .... B41J 3/4078; B41J 11/0021; B41J 11/002; B41J 29/02; B41J 2/17513; B41J 2/17509; B41J 29/13; B41J 2/17553; B41J 2/1606; B41J 2/1642; B41J 2/1609; B41J 2/1433; B41J 2/164; B41J 2/162; B41J 2/161; B41J 2/19; B41J 15/04; B41J 2/1623; B41J 2202/00; B41J 2202/03; B41J 2/14201; B41J 2/045; B41J 11/0015; B41J 2/04581; B41J 2/055; B41J 2/16538; B41J 2002/16502; B41J 2/04588; B41J 2/04595; B41J 2/04586; B41J 2/14274; B41J 2/01; B41J 2/211; B41J 2/17; B41J 2/17593; B41J 2/2107; B41J 2/1755; B41J 2/2114; B41J 2/2117; B41J 2/2056; B41J 2/21; B41J 2/0057; B41J 3/60; B41J 2002/012; B41J 2/04598; B41F 23/042; B41F 23/0436; B41M 5/0011; B41M 5/0017; B41M 5/0023; B41M 5/0047; B41M 7/00; B41M 7/0072; B41M 5/52; B41M 5/5218; B41M 5/5227; G09F 7/00
See application file for complete search history.

(56) References Cited

U.S. PATENT DOCUMENTS 9,498,977 B2 11/2016 Allen et al.
9,757,961 B2 9/2017 Allen et al.
10,029,487 B2 7/2018 Allen et al.
(Continued)

*Primary Examiner* — Manish S Shah
(74) *Attorney, Agent, or Firm* — Padda Law Group

(57) ABSTRACT

Eco-friendly signs such as wood and other natural material signs, and methods of making eco-friendly signs, including selecting a substrate as a base material having a first planar surface and an opposing second planar surface, cutting the substrate to a sign dimension, treating the first planar surface to form a smooth print surface, applying a base layer such as a layer of clear ink to the print surface, and applying a signage layer onto the base layer. The eco-friendly sign may be an ADA compliant sign in which the signage layer is a raised of ink produced using a 3-dimensional printer.

5 Claims, 14 Drawing Sheets

(56) References Cited

U.S. PATENT DOCUMENTS

| | | | | |
|---|---|---|---|---|
| 2012/0213973 | A1* | 8/2012 | Clement | B44C 5/043 428/161 |
| 2013/0078437 | A1* | 3/2013 | Symkens | B44C 1/00 428/203 |
| 2014/0199531 | A1* | 7/2014 | Pervan | B41M 3/00 428/207 |
| 2015/0024166 | A1* | 1/2015 | Bilodeau | B44F 9/00 428/141 |
| 2015/0274997 | A1* | 10/2015 | Pervan | B41M 5/502 428/207 |
| 2016/0098948 | A1* | 4/2016 | Henshue | G09F 7/00 40/612 |
| 2016/0229128 | A1* | 8/2016 | Dayagi | C09D 11/033 |
| 2017/0055753 | A1* | 3/2017 | Surber | B41M 5/0047 |
| 2017/0150839 | A1* | 6/2017 | Surber | B41M 5/0047 |
| 2017/0274702 | A1* | 9/2017 | Bilodeau | B44F 9/00 |

* cited by examiner

Instructions For Raised Content and Braille

File Prep

1) Populate desired color to all objects.
2) Create 3 pages.
3) Make all content on pg 1 SF3 (clear base coat).
4) On pg 2, set color to SC5 (CMYK ADA) and SF2 primer coat.
5) On pg 3, set content to desired final color.
6) Double check job pallet shows SC5, SF2 & SF3 twice, check top boxes in each layer if needed.

Output Instructions

1) Wipe down blank with microfiber cloth.
2) Print clear base coat - select all, print only page 1 using queue 1800Z 4CP plus W.
3) Set height direct to sign blank (NO ADA SHIM).
4) Have return on red and print.
5) Print raised color - Set height with ADA shim, remove shim and home printer, select all, print pages 2 - 3, using queue Raised then Color - 1800 local.
6) Have return on yellow and print.
7) After printing inspect for quality.

The two things to be very aware of are that the blank not move during at all during output and to have the blank as perfectly clean as possible.

FIG. 14

ECO-FRIENDLY SIGNAGE

CROSS-REFERENCE TO RELATED APPLICATION

The present disclosure claims priority to Provisional Application No. 62/809,943, entitled Eco-Friendly Signage and filed Feb. 25, 2019, the content of which is hereby incorporated by reference herein in its entirety.

FIELD OF THE INVENTION

The present disclosure relates to eco-friendly signage. More specifically, the present disclosure relates to signage using an eco-friendly substrate and 3D printing.

BACKGROUND OF THE INVENTION

In the late 1980s and 1990s, the sign industry evolved from hand painting to the widespread use of computer driven equipment to print and cut materials. The switch to automated machinery increased demand for standardized material. While plywood had been a common substrate for signage, automation led to plastics becoming the dominant material for almost all sign applications. While aluminum and steel are the primary structural materials for large exterior signs, their design elements and the entirety of most other signs are made predominantly of PVC, acrylics, and other polycarbonates. These materials are toxic to the environment and difficult to recycle. Nevertheless, their durability, ease of access, and uniformity have made them ubiquitous.

The Americans with Disabilities Act (ADA) was signed into law in 1990 and guarantees equal opportunities to persons with disabilities. Under the ADA, persons with physical or cognitive impairments are protected from unfair limitations to their conduct of daily life.

A significant part of the ADA governs the physical environment in the public sphere, for example in accessibility to transportation, public spaces, and commercial spaces. ADA compliant signage is a requirement for all government, public accommodation, and commercial buildings to provide basic information such as room numbers and the location of exits, elevators, and restrooms. ADA signage features tactile lettering as pictograms as well as Braille, making them functional for blind persons or those with limited vision.

Given the increasing ubiquity of ADA signage, these elements of the built environment are excellent candidates for consideration in green design. More specifically, they are excellent candidates for architectural and construction decisions that reduce harmful effects on the environment and human health by choosing eco-friendly materials and build practices.

In the United States, the median commercial building size is 5,000 square feet. The average commercial building size in 2012 was 15,700 square feet. Using a conservative value of 200 square feet as an average room size, the median commercial building contains approximately 25 rooms and the average building approximately 75 rooms. Considering hall space, elevator, and exit signage, a reasonable estimate for numbers of ADA signs for a building is 50-100, recognizing that larger buildings may require hundreds of ADA compliant signs.

There are upwards of 6 million commercial buildings in the US, containing over 87 billion square feet of workspace. This figure does not include government buildings or schools, hospitals, and other public buildings requiring ADA signage. Therefore, the national need for ADA signage is on the order of hundreds of millions of sign units. As is described more fully below, this volume of acrylic signage implies a significant use of fossil fuel inputs, toxic starting materials, and persistent plastic waste negatively impacting the environment.

The 2010 ADA Standards for Accessible Design (2010 Standards) regulates ADA signage. ADA signs are typically manufactured as a subspecialty of sign-making enterprises, whether by large national companies or local small businesses. A variety of materials are used in the manufacture of ADA signage, based on considerations of durability, aesthetics, and cost. The majority of ADA compliant signs are made of plastic, and while these are often a cost-effective option, they entail production methods and general lifecycle characteristics that are not environmentally friendly. The manufacture of plastic sign components depends on toxic starting materials that are derived from fossil fuels, produced on an industrial scale, and present occupational and environmental hazards in production. The production of the signs from plastic blanks involves significant waste and associated landfill inputs. At the end of their useful life, plastic signs become persistent waste in the environment, take up valuable landfill space, and contribute to plastic and microplastic pollution that is harmful to wildlife and the environment.

"Plastic" is a generic term for synthetic polymeric material. Acrylic is the type of plastic used to make most ADA signage. Acrylic features high clarity, a gloss surface, and scratch resistance. The chemical name of acrylic is polymethyl methacrylate (PMMA), formed by the polymerization of methylacrylate monomers. The monomer starting material for the chemical synthesis of PMMA is called methyl methacrylate or MMA. Global annual production for PMMA is close to 3 million metric tons, while close to 5 million metric tons of MMA monomer are produced globally every year. Acrylic is used in an incredible variety of products and applications, from display cases, windows, vehicle parts, and paint additives, to exterior and interior building signage.

The manufacture of MMA is based on fossil fuel inputs. One of two chemical processes are commonly used to synthesize MMA. One involves the industrial scale reaction of acetone with hydrogen cyanide, followed by reaction of the resulting intermediate product with sulfuric acid. The other synthetic process is based on reaction of ethane, carbon monoxide, and methanol. A principal concern with acrylic based signage is therefore its provenance in toxic starting materials that (1) are derived from non-renewable fossil fuels and (2) depend on industrial processes that are inherently hazardous to workers and the environment.

Production of acrylic ADA signs generates significant waste. Acrylic-based signs are typically made from acrylic blanks cut from sourced panels that leave roughly 10% waste material from cutting the blanks to size. A polymeric, acrylic-based applique with the intended text and pictogram is adhered to the blanks and cut with a laser router, leaving up to 90% of the applique material as waste for text applications and up to 50% waste for pictograms. Therefore, the production of a typical 6" by 9" acrylic sign yields up to 100 grams of environmentally persistent waste by-product material.

Like buildings themselves, ADA signs have a useful life followed by a need for disposal, whether due to interior remodeling, building redesign, or demolition. The qualities of acrylic that make it a useful signage material also make it difficult to dispose of without environmental impact.

Acrylic is substantially impervious to degradation by common environmental mechanisms such as heat, water, sunlight, and microbial degradation. Acrylic is also very difficult to recycle and is therefore not collected in most recycling streams. The available recycling process involves the use of lead—a highly toxic material—to depolymerize acrylic. When deposited in landfills, acrylic signs add significant volume and, due to their chemical heat and oxidative stability, will persist for centuries. Acrylic signs that are not properly disposed of will persist for hundreds of years, though exposure to environmental conditions can result in physical wearing that is a source of plastic particles (i.e., microplastics) that end up in waterways and eventually the ocean, negatively impacting sea life.

While specific reference is made to the manufacture of plastic ADA signs, it is to be appreciated that the shortcomings of plastic ADA signs apply also to any plastic signs.

3D printing can be used to print characters on signage. This is particularly the case where the sign substrate is a significantly non-permeable and uniform base such as plastic.

ADA compliant signage requires raised letters, pictograms, and braille. These are provided relatively easily on plastic signage. Printing raised letters, pictograms, and braille on wood has several challenges. Specifically, direct fusing of 3D printing ink to a natural material has several challenges. Wood has a naturally uneven surface. Pits and valleys are present on virtually all slabs of wood. In addition, wood has saps and oils and is composed of fibers. Wood has an uneven surface with pits and valleys being present on virtually all wooden surfaces.

When 3D printing on a wood surface, the image printed can be uneven because of ink first filling the pit or valley whenever a pit or valley is present. FIG. 1 is an image of an example of 3D printing of a pictogram 10 on a wood surface 12 where the wood surface includes micro-valleys 14. This example was made without use of the new methods described herein. The pictogram has corresponding micro-valleys 16 such that the raised printed surface is not planar but rather has many linear indentations and ripples.

In addition, wood has sap and oils that can cause problems when 3D printing on wood. Due to the high temperature required to set 3D printing ink, the natural saps and oils in wood can explode or start to flow, creating cavities in the wood substrate and visual defects in the build itself. These usually follow the grain of the wood, often caused by events below the surface of the wood itself. FIG. 2 illustrates a close up image of surface 20 with a printed letter "P". The surface 20 is free of defects except for a linear cavity running along the top part of the "P" caused by flowing oils and saps disturbed by the heat in printing. The right part of the defect is bonded to the rest of the build but the left is not. This indicates that the build was disturbed by movement under the surface, with more movement on the left side causing a greater defect (comparable to a whole tectonic plate moving but an earthquake being localized).

Another feature of wood which can cause problems when used as a foundation for printing is that natural wood comprises fibers. Ink has a tendency to run along the fibers, creating a visual defect. FIG. 3 is a close up image of a wood surface 30 on which ink 32 was printed without the use of various novel improvements described later in this disclosure. FIG. 3 illustrates ink flowing along the fibers of the wood, creating a visual imperfection. Rather than having a smooth edge, the ink as extended in lines 34 onto the wood along the edge of the ink.

There can be problems with ink not setting on the surface, flowing into the wood before it can build. FIG. 4 is a close up image of a wood surface 40 on which ink 42 was printed but the UV intensity settings were improper such that the ink 42 flowed into wood 40 before the UV lamp could fuse the ink properly.

Wood can also have fissures and these fissures can carry over to ink printed on the wood. Frequently, removing a layer of the wood from the surface may not be sufficient to address the issue of the fissures because micro fissures may be present in the new layer. FIG. 5 is a close up image of a wood surface 50, in this case red oak, in which fissures 52 are part of the growth pattern.

Therefore, there is a need for a method of providing eco-friendly signage. More particularly, there is a need for a method of providing eco-friendly ADA signage.

SUMMARY

Various embodiments include eco-friendly signs. The signs may be produced by a method including selecting a substrate as a base material, the substrate having a first planar surface and an opposing second planar surface, cutting the substrate to a sign dimension, treating the first planar surface to form a smooth print surface, applying a base layer of ink to the print surface, and applying a signage layer onto the base coat. For example, treating the first planar surface may include sanding the first planar surface. The base layer may be an ink such as a clear ink. The base layer may include a first layer and a second layer. In some cases, the first layer and the second layer may be the same ink material. The first layer and the second layer are applied as droplets, and the droplets of the first layer may be larger than the droplets of the second layer.

The method of producing the eco-friendly signs may also include the step of cleaning the substrate after treating the first planar surface and prior to applying the base coat. In some embodiments, cleaning the substrate includes applying a vacuum to the first planar surface of the substrate such as by inserting the substrate into a vacuum device.

In some embodiments, the substrate of the eco-friendly sign may be a natural material such as wood. In some embodiments, the substrate may be an aspen wood substrate.

In some embodiments, the eco-friendly sign may be produced by the method including selecting a wood substrate as a base material, the substrate having a first planar surface and an opposing second planar surface, cutting the substrate to a sign dimension, sanding the first planar surface to form a smooth print surface, applying a base layer of clear ink to the print surface, and applying a 3-dimensional signage layer onto the base layer, wherein the eco-friendly sign is compliant with ADA regulations. The signage layer may be raised at least 1/32 of an inch above the base layer, for example. The method may further include setting the 3-dimensional signage layer with UV light.

In some embodiments, applying a 3-dimensional signage layer onto the base coat includes applying one or more layers of ink using a 3-dimensional printer. Applying a clear base layer may includes applying one or more layers of clear ink using the same 3-dimensional printer.

In some embodiments, applying one or more layers of clear ink includes applying a first layer of clear ink in the form of uniform droplets and then applying a second layer of clear ink in the form of irregular droplets. The uniform droplets of the first layer may have a size which is greater than a size of the irregular droplets of the second layer. For example, the droplets of the second layer may include small droplets which are about 1/10 or less of the size of the droplets of the first layer.

Other embodiments include methods of producing an eco-friendly sign. In some embodiments, the method includes selecting a substrate as a base material, the substrate having a first planar surface and an opposing second planar surface, cutting the substrate to a sign dimension, treating the first planar surface to form a smooth print surface, applying a base layer of ink to the print surface, and applying a signage layer onto the base coat.

BRIEF DESCRIPTION OF THE DRAWINGS

While the specification concludes with claims particularly pointing out and distinctly claiming the subject matter that is regarded as forming the various embodiments of the present disclosure, it is believed that the disclosure will be better understood from the following description taken in conjunction with the accompanying Figures, in which:

FIG. 14 illustrates a sample instruction sheet regarding for Instructions for Raised Content and Braille.

DETAILED DESCRIPTION

Figure 1:
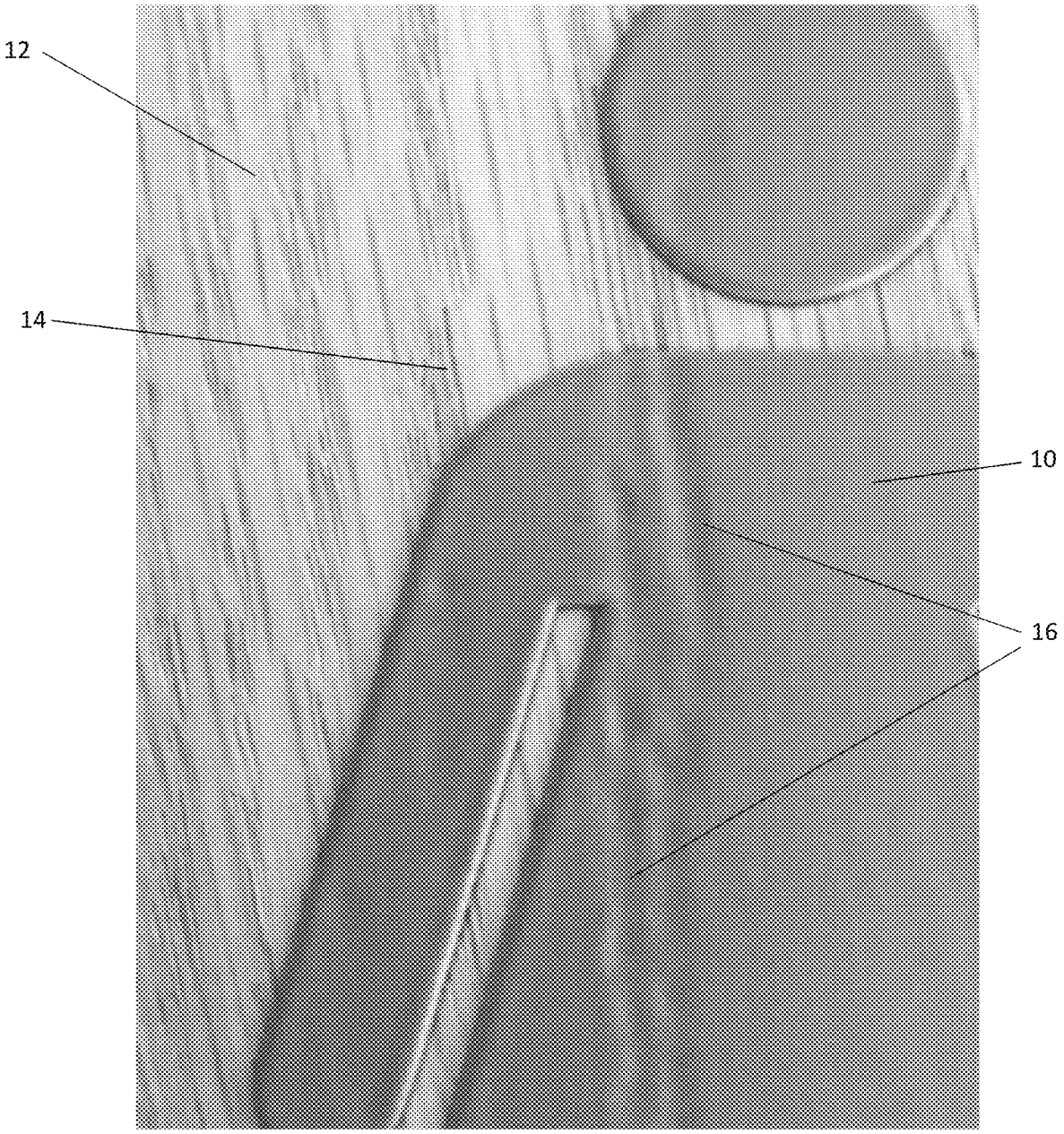
FIG. 1 illustrates 3D printing of a pictogram on a wood surface where the wood surface includes micro-valleys.
Figure 2:
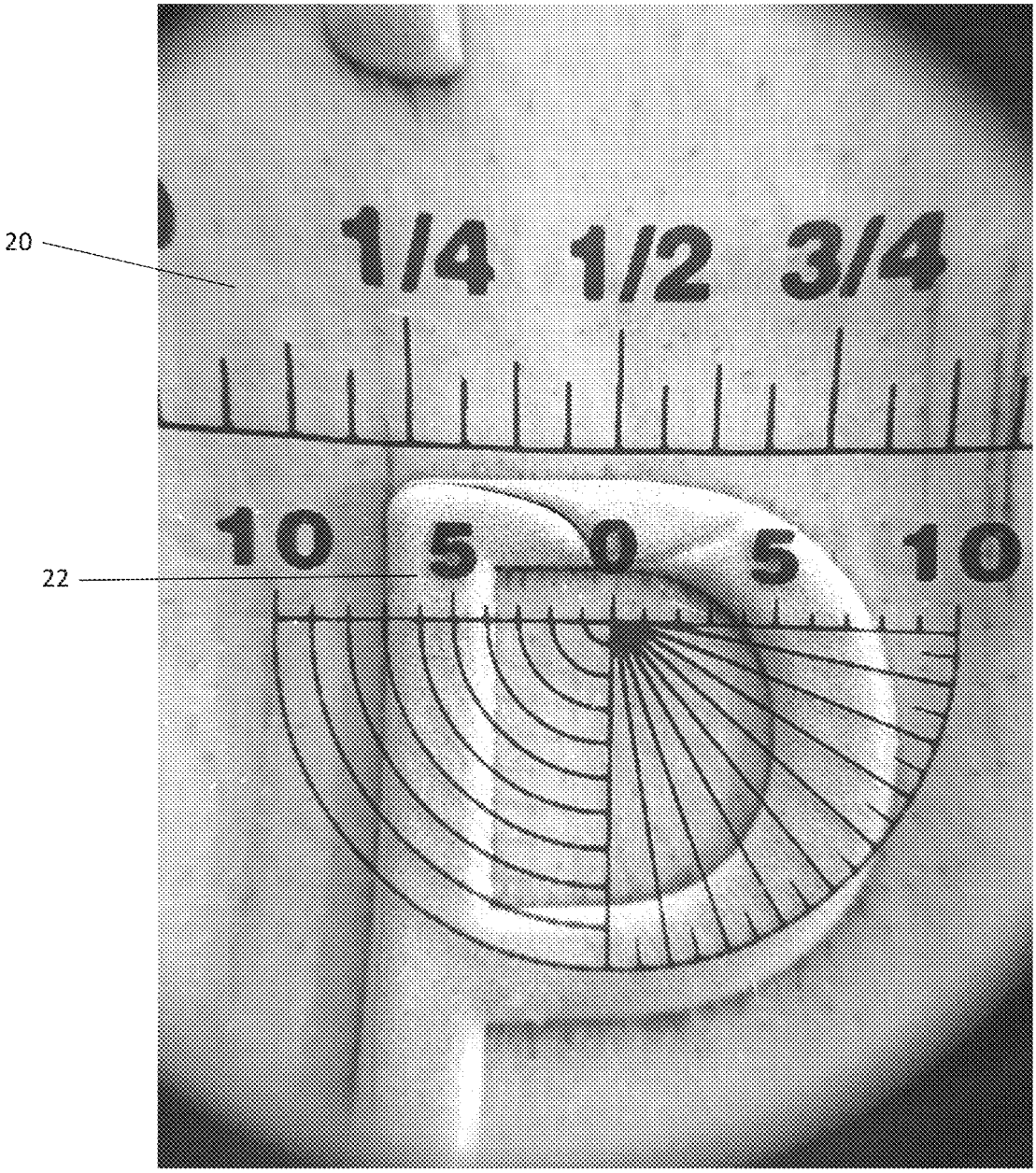
FIG. 2 illustrates a printed surface free of defects except for linear cavity caused by flowing oils and saps disturbed by the heat in printing.
Figure 3:
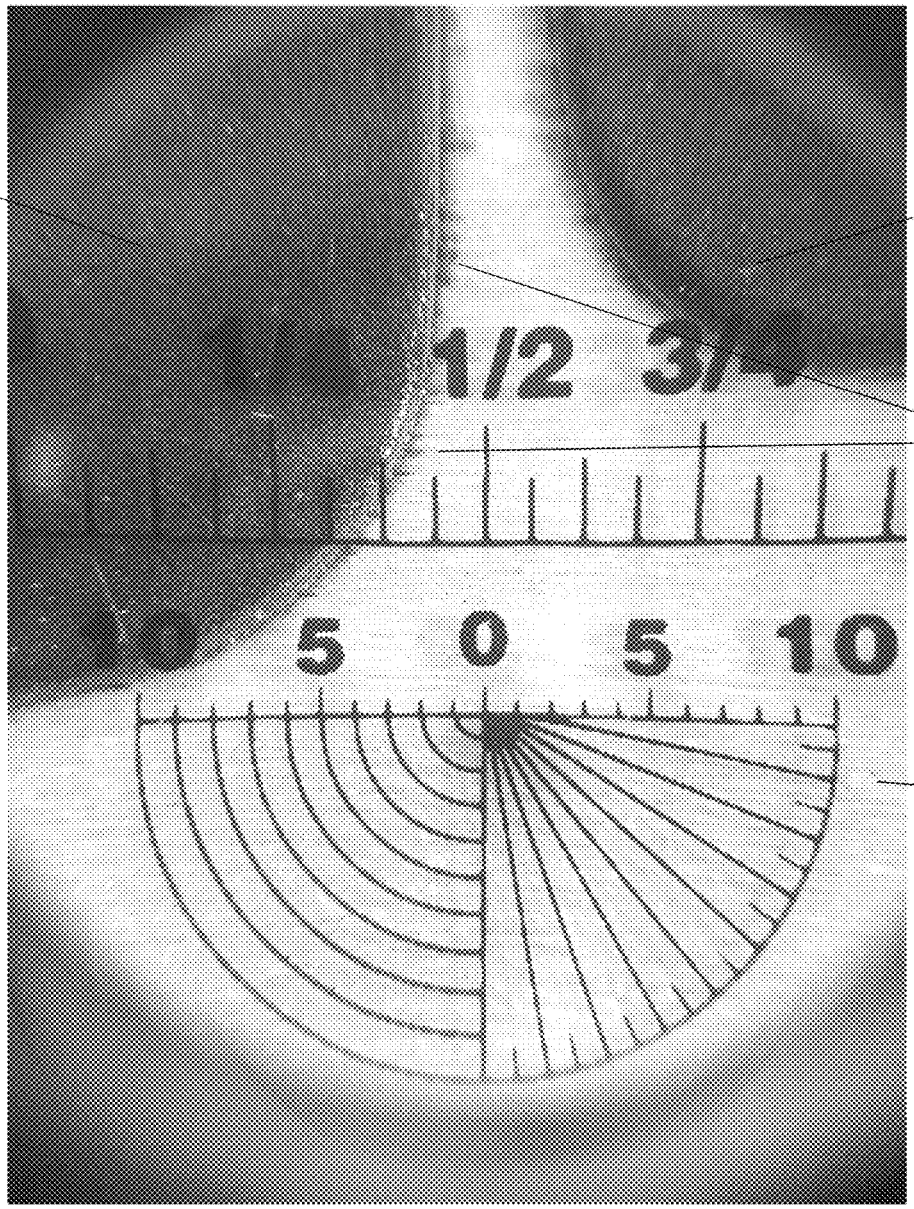
FIG. 3 illustrates ink flowing along the fibers of the wood, creating a visual imperfection.
Figure 4:
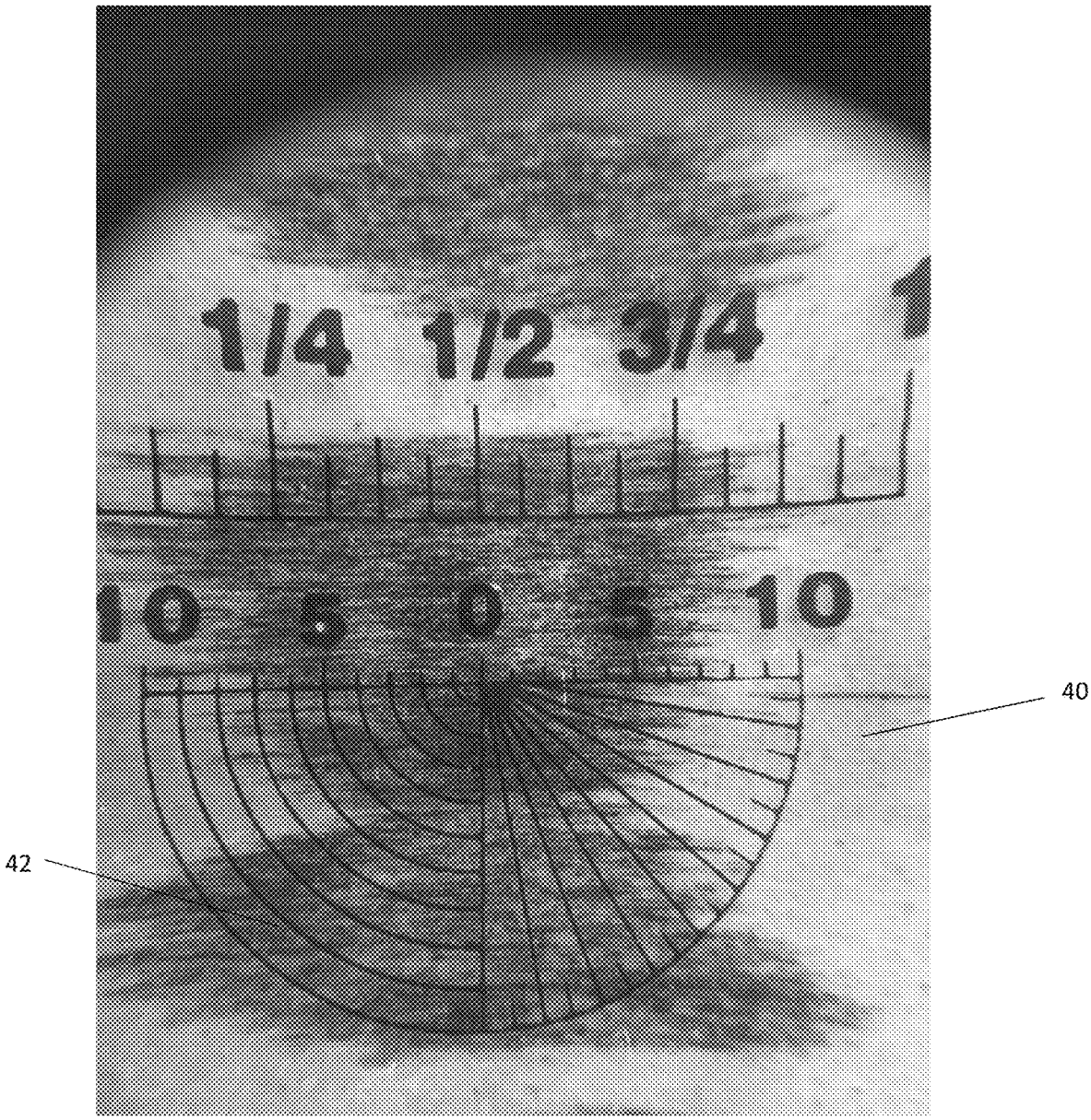
FIG. 4 illustrates ink flowing into wood before a lamp can fuse it properly.
Figure 5:
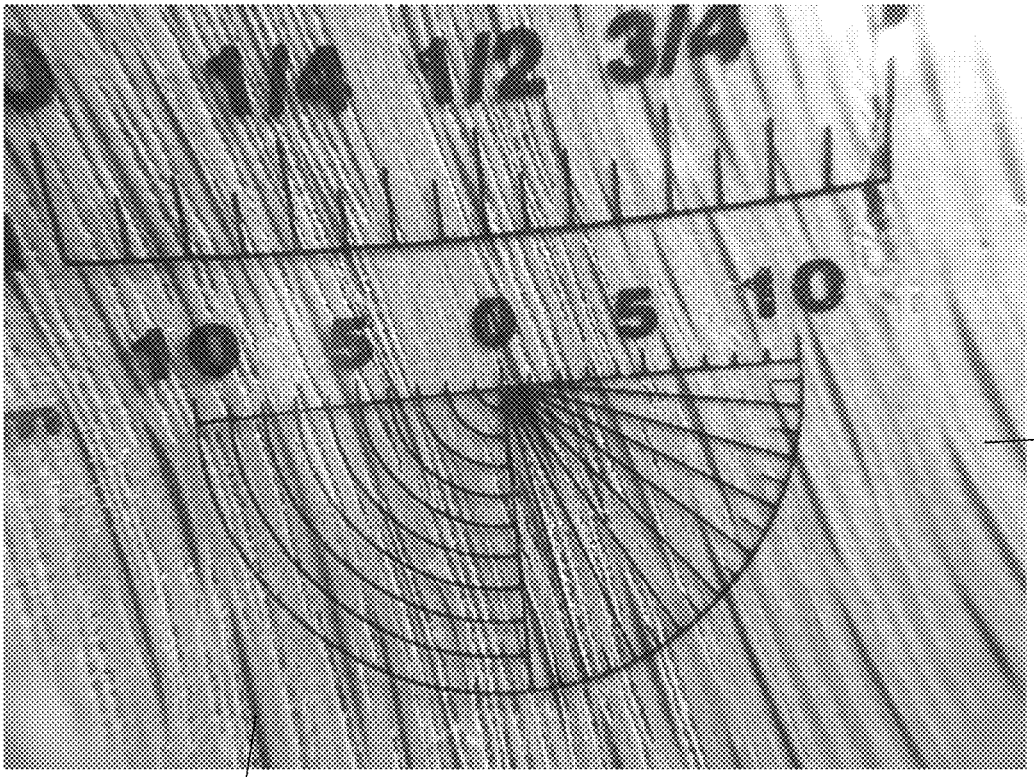
FIG. 5 illustrates fissures in red oak that are part of the growth pattern.

The present disclosure relates to signage including eco-friendly and ADA compliant signage. While multiple embodiments are disclosed, still other embodiments of the present disclosure will become apparent to those skilled in the art from the following detailed description, which shows and describes illustrative embodiments of the disclosure. As will be realized, the various embodiments of the present disclosure are capable of modifications in various obvious aspects, all without departing from the spirit and scope of the present disclosure. Accordingly, the drawings and detailed description are to be regarded as illustrative in nature and not restrictive.

Eco-friendly signs manufactured in accordance with the teachings of the present disclosure may be formed from natural and/or sustainable materials. For example, the signs may be made from sustainable, responsibly sourced wood, or other natural materials. The use of recycled, site-significant wood is also an option. The sign material may be shaped such as by cutting and milling to an appropriate size and shape to form a sign blank. The sign surface may be prepared such as by smoothing the surface, cleaning the surface and applying a base coat. Once prepared, lettering may be applied such as ADA-compliant lettering, pictograms and Braille components which may be printed using 3D printing and inks which may be non-toxic inks. In some embodiments, roughly 1% of the total weight of the resultant sign is 3D ink and the remaining approximately 99% is made of renewable material.

In some embodiments, the present disclosure relates to using renewable, sustainably sourced wood as a sign substrate and applying eco-friendly 3D inks to accomplish tactile signage layers including lettering, pictograms, and/or Braille features of signs such as ADA signs. The resultant signage is aesthetically pleasing, functional, and ultimately compostable or recyclable, thus reducing landfill and environmental impacts when their useful life has ended.

Methods disclosed herein may use direct 3D printing of text, pictograms, and/or Braille on natural substrates which may act as sign blanks. The 3D printing process is highly efficient, generally with less than 0.02% ink waste during the printing process. When using a wood substrate, cutting wood to size leaves sawdust and wood fragments as scrap, both of which are biodegradable and compostable. Further, the resultant sawdust may be processed into wood pellets for heating purposes.

Signs produced according to the methods described herein offer an eco-friendly solution to disposal issues. Whereas an acrylic sign is environmental waste for centuries, signs produced according to the methods described herein can be naturally recycled in a matter of months, for example, because materials such as wood are biodegradable. Wood-based signs may alternatively be chipped for compost or mulch. The non-toxic inks generally comprise 1% or less of the sign volume and do not present environmental or human health hazards. The inks may be removed from the signs prior to re-use of the wood, such as by sanding or scraping the inks off of the wood.

Figure 6:
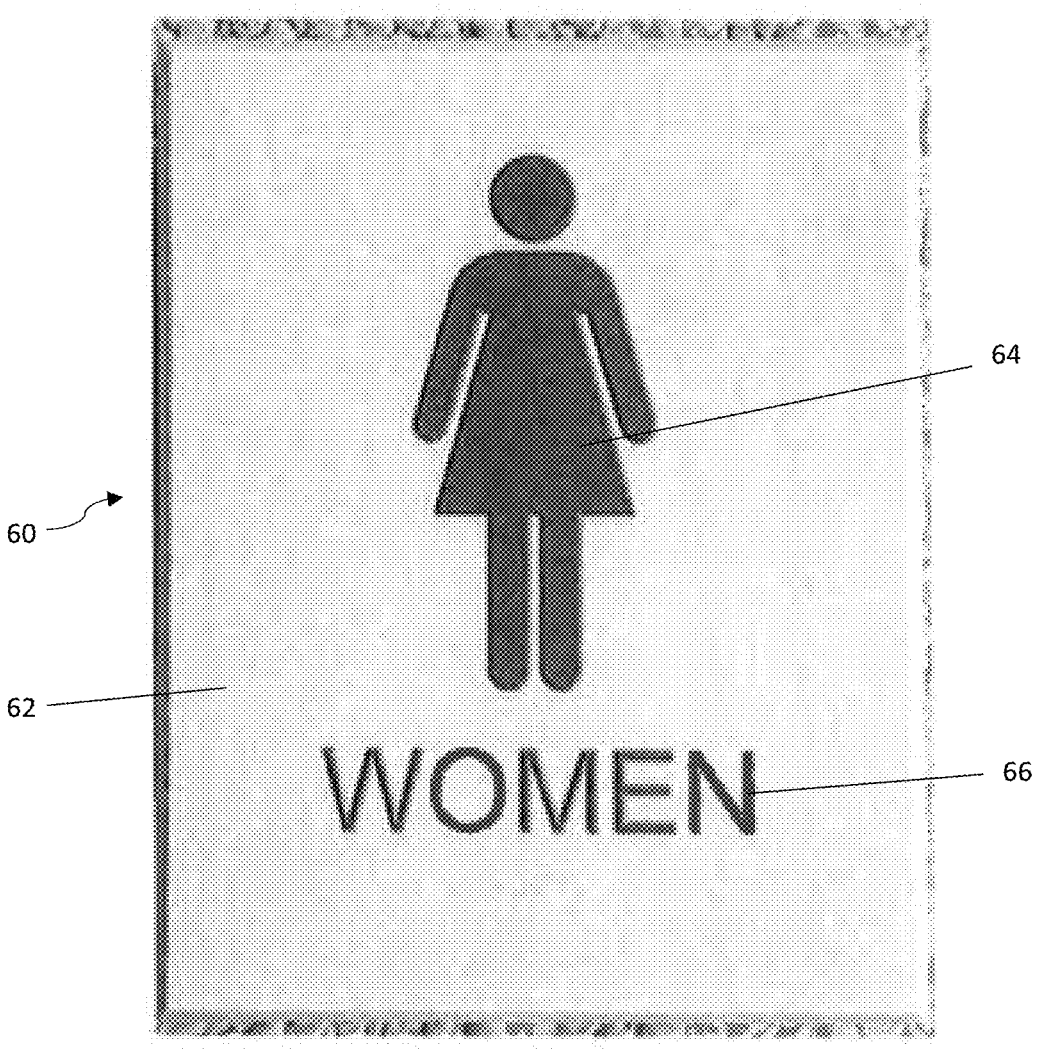
FIG. 6 illustrates a printed sign, in accordance with one embodiment.

FIG. 6 illustrates an example of a printed sign 60 in accordance with various embodiments. The sign 60 includes a wood substrate 62 which forms the majority of the sign 60, a pictogram 64 illustrating a woman and lettering 66. The sign 60 utilizes roughly 99% less plastic then traditional ADA signage comprised of plastic materials.

In general, the following steps may be used, in combination and/or with other steps, to facilitate printing such as 3D printing on a natural surface such as a fibrous surface like wood, to provide eco-friendly signage such as ADA compliant signage. In summary, the signs may be produced by first selecting a substrate and then optionally cutting the substrate and finishing the substrate edges. The print surface of the substrate may be selected based on the qualities of the surfaces. The print surfaces and optionally the back surface of the substrate may be treated to smooth them and remove defects. The substrate surfaces may then be cleaned prior to printing. A base coat which may be clear may be applied to the print surface of the substrate. The signage layer may then be applied over the base coat. The steps may be performed in a different order than presented here, and various steps may be omitted or additional steps may be added. These steps are described in further detail below.

In some processes, the first step of creating the sign may be selection of the substrate, including selection of the type of material as well as the specific piece of material to be used for a sign. When selecting a substrate, consideration may be given to the ultimate use of the sign. For example, in general, for ADA compliance, the background of the sign may need to be highly uniform. Accordingly, the sign blank substrate may be selected which is substantially free from knots or from dramatic changes or variations in natural coloration. In addition, it may be useful for the sign to be free of substantial cracks. It may also useful for the sign blank to be straight and level in order for the ink to build well when multiple layers of ink are applied. Accordingly, noticeable twists or curves may not be desirable and substrates having such features may be avoided.

When wood is used as a substrate, results may vary depending on the type of wood selected. Wood may be selected based on desired results. Some woods may have too much oil, surface pitting due to grain, and/or visual characteristics of natural grain too varied for a desired output such as an ADA compliant sign. Woods with high sap contents (such as pines and similar aromatic woods) may be used in some embodiments but may have lower quality results in some cases. Woods with high fibrosity (such as mahogany) may have inconsistent results due to variations in color and contrast requirements and may be used for some embodiments and avoided for others. Poplar may also have poor results because of significant color shifts within a typical board, from white to green, so it may be used for some embodiments but may be avoided for others such as ADA compliant signs in which the color scheme may be problematic. It is to be appreciated, however, that while characteristics of a particular type of wood may make it less suitable for one application, it may not be significant or problematic for a different application.

Wood may be selected that has a more uniform coloration and/or uniform texture for some embodiments. For example, aspen and wood types having a similar consistency may be used in various embodiments. Examples of woods having both generally uniform coloration and smooth texture which may be used in various embodiments including aspen, maple, walnut, and fruit woods such as cherry and apple. Woods of these types may be used to achieve high quality output. In addition, wood may be selected to provide a high contrast between the wood base and the colored printed ink of the sign. For example, wood may be selected which has a lighter color. This high level of contrast may be useful for any sign but may be particularly useful for ADA compliant signs.

During selection of the substrate, the material may be visually inspected with regard to color, shape, etc. For example, when a wood substrate is selected, it may be visually inspected for color shift. If color shift is present, the substrate may be suitable for some purposes such as with ink signs applications which only include dark colors such as black. The substrate may be inappropriate and may be rejected for use with signs having lighter colors or more color variation. In addition, the end grain may be inspected to determine whether the wood might bow or flex over time and to select the surface onto which the sign will be printed. In the case of an ADA compliant sign for which 3 dimensional lettering and/or images are planned, if bowing is present, the convex side may be selected for printing in order to put less pressure on the raised features as the wood flexes over heat and moisture cycles. Concave flexing pressures the wood-to-print bond more than convex flexing.

While wood may be selected as the substrate in some embodiments, other eco-friendly materials may alternatively be selected such as glass, frosted glass, natural stone, terra cotta, fired clay, ceramic, concrete, cement, metals such as anodized aluminum, drywall such as painted drywall, leather, bone, or other natural and/or sustainable materials. In some embodiments, the substrate may be made of a wood composites which may include pressed wood fibers, for example. In some embodiments, the substrate may include more than one eco-friendly material in combination.

In still other embodiments, the substrate may be a component of the building itself such as the material of which an interior or exterior wall is made. For example, the substrate may be a long board that will be included in the building as a component of the wall façade. The building component may be prepared and printed as a sign according to the steps described herein, and may then be added to the building during construction, renovations, or as a replacement to an existing building component.

After the substrate is selected, it may be cut to the appropriate size (if not already having the appropriate size). Alternatively, the substrate may already have a desired size and shape when selected as the sign blank substrate (or the substrate may be selected which may already fall within designated dimensions). When the substrate is cut, it may be cut to the specifications of the sign. In some embodiments, a compound miter saw may be used to cut the substrate, such as a compound miter saw outfitted with a zero clearance blade insert and zero clearance fence may be used. The substrate piece may be placed on the miter and a jig on a saw fence may be used, for example, to cut the substrate to the desired size which may be predetermined standard dimensions or custom dimensions, for example. In some embodiments, the substrate may be cut with the print surface up to reduce handling marks on the print surface.

Figure 7:
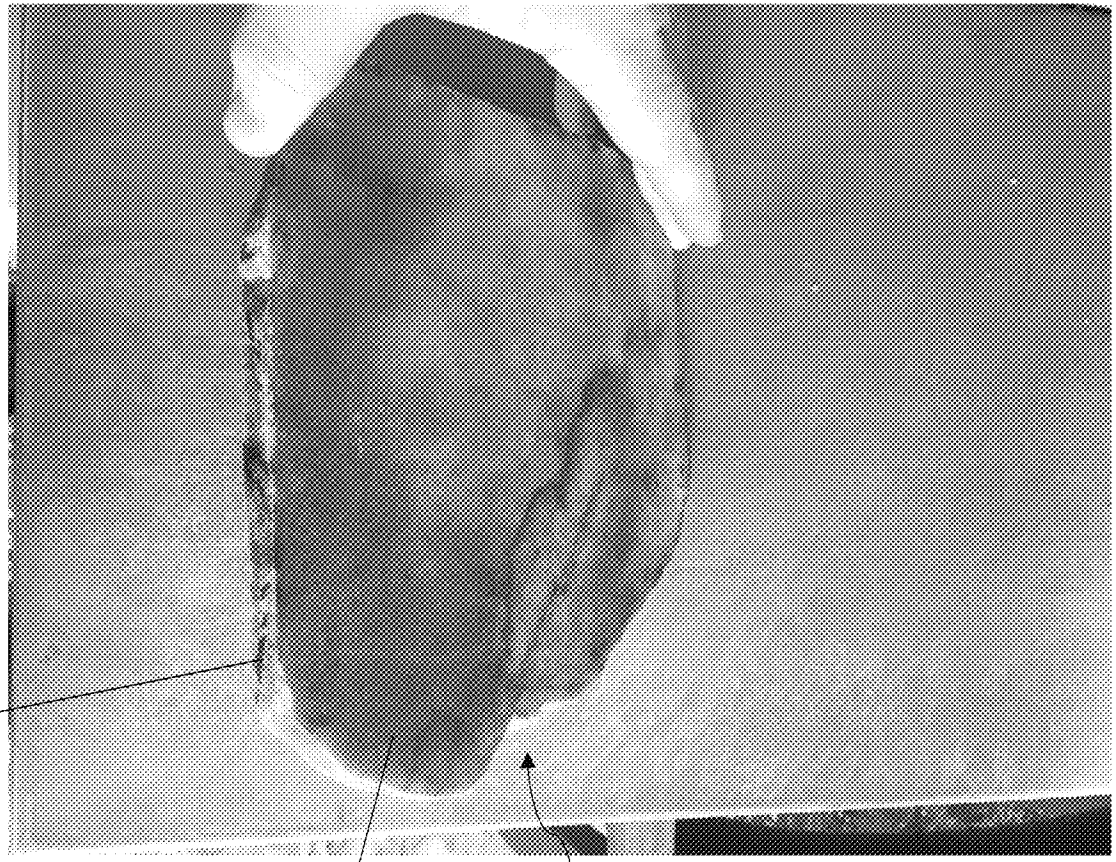
FIG. 7 illustrates a natural piece of stone that could be used as a sign substrate.

When natural materials other than wood are used as sign substrates, they may be cut to a desired size and/or shape to have a smooth planar print surface to which the ink of the signage layer may be applied. The opposing second surface may also be planar to accommodate placement of the sign on a building surface such as a wall or door. The surrounding edges may be cut to a desired size and finished such as by honing or sanding. Alternatively, the surrounding edges may be uncut and left as the natural outer surface of the material. When pliable materials are used such as clay, glass and terra cotta are used as the substrate, the substrate may be created having the desired size and shape and surfaces during production such that no cutting or other changes are needed. FIG. 7 is an image of a natural piece of stone 70 that could be used as a sign substrate. The stone has a generally planar first surface 72 to which the sign ink may be applied. The edge 74 is the natural outer surface of the stone.

After the substrate is cut to the desired size (if necessary), the substrate edges may be finished. For example, the edges of the substrate may be smoothed to remove blade or handling imperfections. Such smoothing may be done by sanding the edges, for example. For cut edges, a low grit belt sander, such as a belt sander having 60 or 80 grit, depending on type of wood and depth of imperfections, may be used. Sanding may optionally progress to a 120 grit belt sander, then a 220 grit rotary sander, as needed. The edges may be visually inspected to ensure a generally smooth and uniform appearance before moving to the next step.

In some embodiments, the edges of the substrate may be finished by forming a decorative edge. For example, if desired, a decorative edge routing may be applied to the sign blank. In some embodiments, the decorative edge is provided by chambering the edge. When running against the grain, sacrificial wood may be held to the blank on the outfeed side to ensure no blowout. In applying the edge routing, it may be useful to first run the against-grain sides and then run the with-grain sides. After edge routing, it may be useful to inspect the sign blank for defects and rerun the edge as desired.

After the substrate is selected and cut to the appropriate size if necessary and the edges have been smoothed if necessary, the substrate may then be treated to smooth the print surface and optionally the back surface. In some embodiments, treating the substrate to smooth the substrate may be done to make the print surface "glass smooth." In some embodiments, the substrate may be treated by face sanding. Desirable characteristics such as bevels, decorative routed edges, design elements and similar features may be added to the substrate (if not inherent) before or after face sanding, depending on what steps are being performed. In some embodiments, a drum sander may be used, such as a drum sander with 220 grit. One or both faces of the substrate may be finished such as by running through a drum sander.

Figure 8:
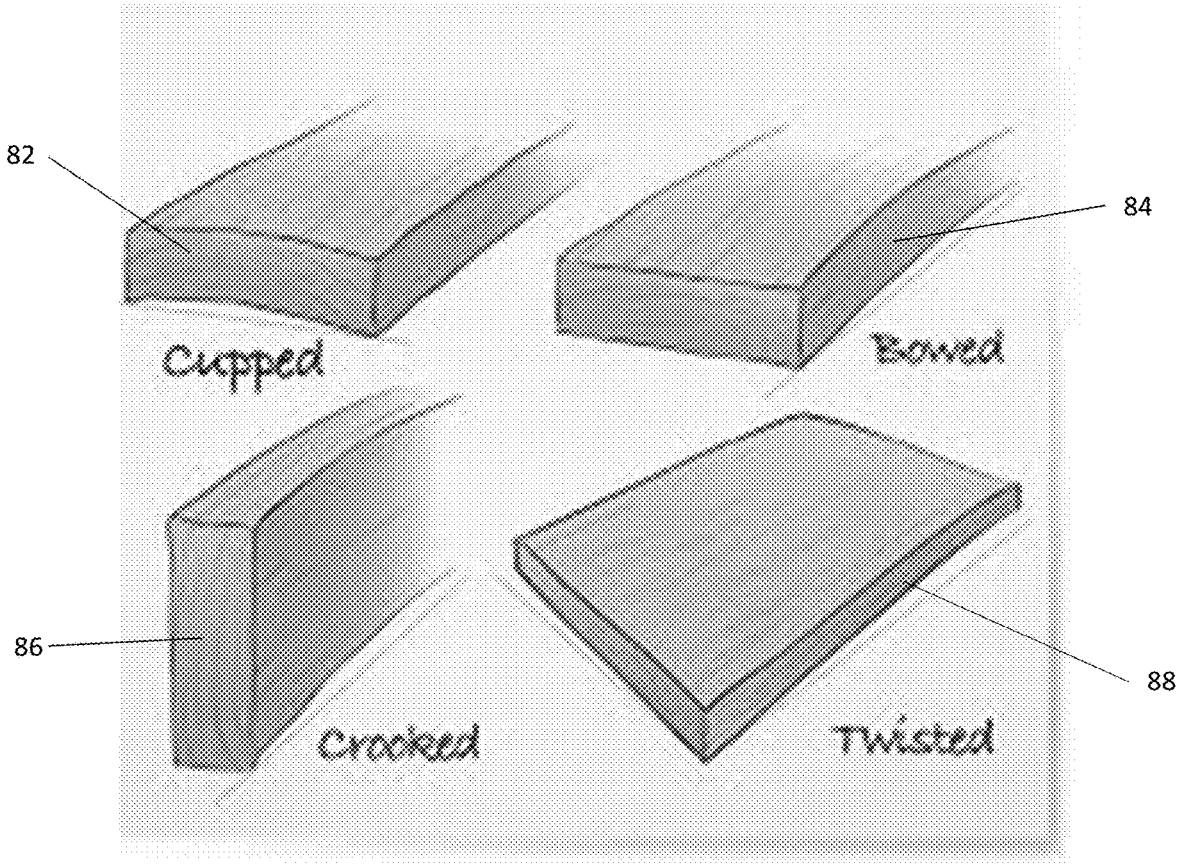
FIG. 8 illustrates various types of deformation.

In some embodiments, both faces may be run through the drum sander to minimize cupping. It may be useful to remove substantially all imperfections from the back of the sign blank. For example, a drum sander with 400 grit may be spot applied to remove any imperfections on the back of the sign. FIG. 8 illustrates various types of deformation of a board along the width axis after drying. Board 82 is cupped, board 84 is bowed, board 86 is crooked, and board 88 is twisted. These aspects of the wood substrate may be minimized by sanding both sides of the board during the process of creating the eco-friendly sign.

During the treatment step, the substrate may be visually inspected to ensure that the surface is smooth and free of imperfections such as cut or route marks. If any imperfections are present, they may be sanded clear. In the case of a wood substrate, all random elevated wood fibers may be removed. This may be done with careful hand sanding, such as with high grit hand sanding. In some embodiments, a surface protector layer such as polyacrylic may be applied to the surface. In some embodiments, a protective layer may be applied to the substrate such as to the wood. For example, in some embodiments, a layer of oil may be applied to the substrate as a protective finish as well as a visual treatment.

Figure 9:
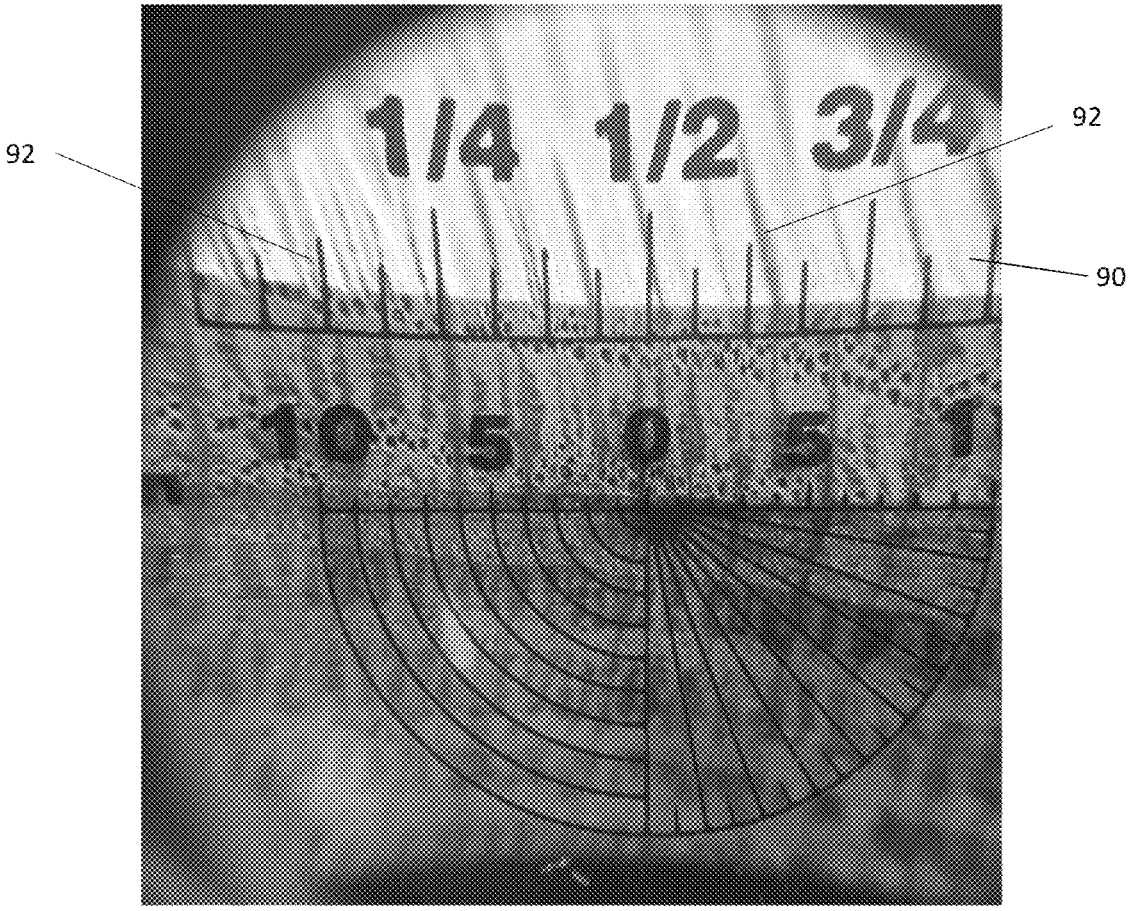
FIG. 9 illustrates a chamfered edge of a piece of wood.

In addition to cracks and knots which may be present in wood substrate which may need to be addressed when preparing the substrate, wood naturally has fibers and growth rings. The fibers and growth rings of wood, combined with the environment and species of wood, define the texture of the wood. The majority of woods may have channels in them that are exposed when the wood is cut or sanded. FIG. 9 is a picture of a chamfered edge a piece of wood 90. As shown, hollow channels 92 are present in the wood. The wood may be sanded and cleaned to achieve the required smoothness. In other embodiments, a wood may be selected having a naturally smoother texture. After treating the sign blank, the print face may be designated. Selection of the print face may be done based on grain pattern, face printing, or other characteristics of the sign blank. Generally, regular grains may lead to better ADA compliance. A print face with less pitting may be easier to print on.

The surface of the substrate on which the sign ink will be printed (the print surface) may be selected at any time during the process of creating the sign. Selection of the print face may be done based on grain pattern, face printing, or other characteristics of the sign blank. Generally, regular grains may lead to better ADA compliance. A print face with less pitting may be easier to print on.

Figure 10:
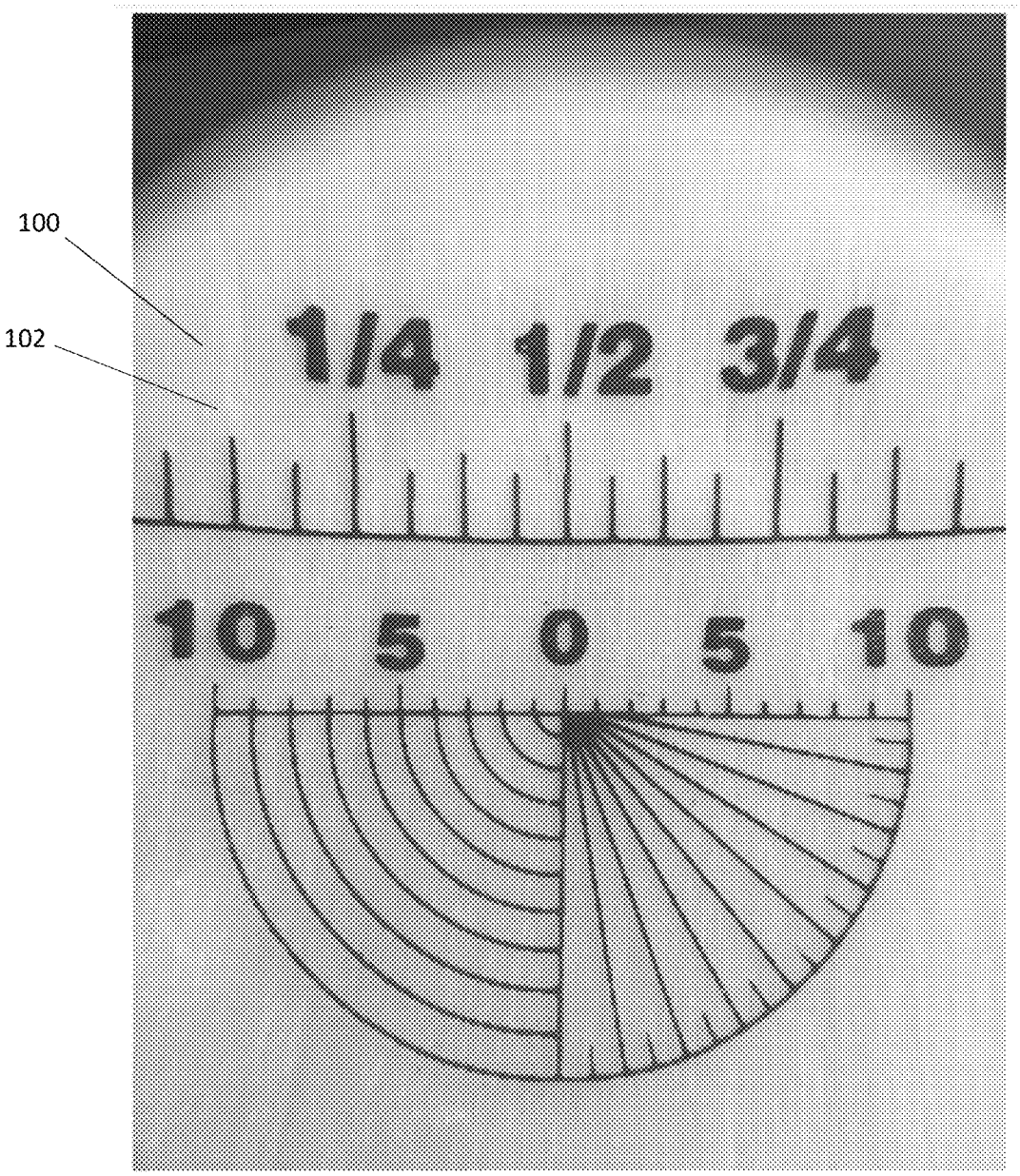
FIG. 10 illustrates a smooth print face of a wood blank, in accordance with one embodiment.

In some embodiments, the print surface may be selected during the surface treatment step. For example, the print surface may be selected before the treatment step or during the treatment step, such as after one or more initial treatments have been performed. After the print surface is selected, additional finishing treatments of the print face side of the sign blank may be done depending on the smoothness of the print face. This additional finishing may be used to achieve desired smoothness of the print face. For example, the print surface may be sanded one or more additional times. In some embodiments, the print surface may be run through the drum sander approximately 0 to 3 more times until the print surface is substantially uniform. An additional sander, such as a rotary sander with 320 grit paper, may be used on the print face to get a finer finish. To achieve an even higher level of smoothness, a hand sander with, for example, 400 grit, may be used on the print surface. FIG. 10 illustrates a wood substrate 100 with a smooth print surface 102 following completion of the treatment step, in accordance with various embodiments.

While sandpaper based finishing methods are discussed herein with, other types of finishing may be used during the treatment steps and other steps. For example, a planer, a cabinet scraper, or a helical planer may be used. Generally, any suitable finisher may be used to provide a smooth finish to the substrate.

After preparing the substrate if needed (such as by cutting, finishing the edges, and/or finishing the surface(s) as described above) and prior to applying the ink, the substrate may be cleaned. Cleanliness of the sign blank can impact proper printing of the sign. For example, the substrate may be cleaned to remove sawdust, wood, dirt, dust or any other surface contamination. Any suitable method of cleaning the sign blank may be used. In one embodiment, the front and back of the sign blank may be cleaned with a shop vac. A microfiber cloth may then used on all sides of the sign blank.

Figure 11:
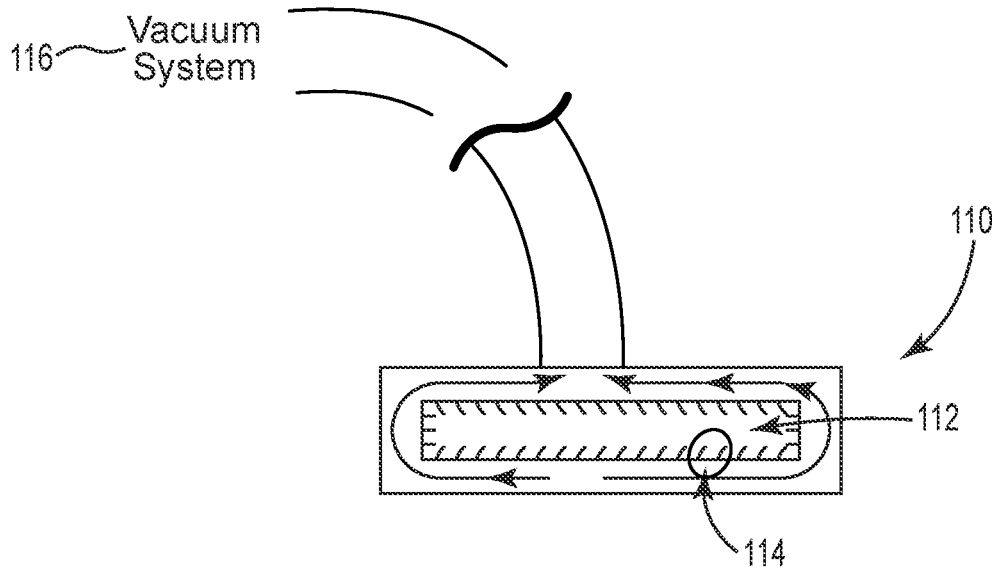
FIG. 11 illustrates a blank cleaning system.

In some embodiments, a dust collector may be used to create a vacuum on the surface of the wood blank. Concurrently, soft bristles may be used to mechanically adjust the location of dust particles. The dust collector and soft bristles may be provided in a generally closed unit. An example of such a closed dust collection unit is shown in FIG. 11. The dust collection unit 110 includes an interior cavity 112 into which the substrate may be inserted or through which the substrate may pass. A plurality of cleaning elements 114 may be located within the cavity 112 to gently dislodge contaminants such as dust from the surfaces of the substrate. In some embodiments, the cleaning elements may be soft bristles, for example. The dust collection unit 110 may include or may be connected to a vacuum source 116 to create negative pressure within the cavity 112 and such away dust and other debris. As the substrate passes through the cavity 112, the substrate passes between and comes into contact with the cleaning elements and the vacuum that surrounds the substrate sucks away the dust from the surface of the substrate prior to printing.

Because of the importance of proper preparation of the substrate prior to printing, further inspections may be performed prior to beginning printing on the substrate. In some embodiments, the substrate may be inspected for dust, scratches, low/high points, exceedingly high color contrast or cracks, or other desirable or undesirable characteristics. Depending on results of inspection, the substrate may be sent back for additional prep work by repeating one or more of the above steps, for example. After inspection, it may be useful to clean the sign blank again, such as by wiping the print surface and/or the back surface with a cloth or other cleaner.

Once the surface is cleaned, a thin base layer may be applied to one or both sides of the substrate. The base layer may be a layer of ink, such as clear ink, for example. The base layer may then be allowed to dry or set, such as through the application of heat as appropriate for heat setting. In some embodiments, the thin layer of ink may be a micro thin layer of clear ink, such as a layer whose height above the substrate is between approximately 0.09 mm and 0.15 mm thick or between approximately 0.10 and 0.12 mm for example. The ink of the base layer may be provided by the same printer, such as a 3D printer, used for the signage layer. This provides various benefits including an easier manufacturing process, no need to allow the coating to cure before printing, less materials to track and inventory, the 3D printing will bond best with itself, and very good repeatability and control. If you were to use pigmented stuff, it would bleed into the wood fibers and create visual defects. Alternatively, other materials could be used as the base, such as paints, varnishes, and stains, for example. Whatever material is selected, it may make the substrate more receptive to printing the signage layer.

The base layer may be applied to the whole substrate or whole print surface of the substrate, or alternatively the base layer may only be applied to the print surface at the location or locations where the sign design calls for the signage layer to be applied later such as through pigmented printing and/or a 3D build.

In some embodiments, the base layer may be a first layer of print. In some embodiments, the base layer may match a configuration established in an output file. In other embodiments, the base layer may be printed according to a base layer output file. Visually, the base layer output file and the print output file may be substantially identical. The first or base layer may be thin and clear. The ADA compliant signage layer may be a build layer that may be output as a slurry of all colors, then a white top coat, then a CMYK coat to define the color.

In some embodiments, the base layer may be printed with a clear ink. Clear ink may provide a contrasting gloss level and may also work as a physical protection. In other embodiments, other inks, such as colored inks such as standard CMYK inks may be used. For example, a substrate with dramatic changes or variation in coloration of the print surface may be painted a uniform color or printed with a layer of colored ink to provide uniform coloration. In some embodiments, the base layer may be applied using the same printer as the signage layer, which may be a 3D printer or other printer. In other embodiments, the base layer may be applied with a different printer or different device than used for applying the signage layer. In some embodiments, the base layer may be applied using a screen printer in a screen printing process, for example. In some embodiments, the base layer and the print layer may be print from the same file and/or may be done with substantially no time between printing of the layers.

In some embodiments, the base layer includes 2 layers. In some such embodiments, a first base layer of ink is applied as comparatively large droplets. A second base layer is then applied over the first base layer as smaller droplets in an array of sizes. For example, the second base layer may have droplets in a range of sizes from approximately 1.5 to 18 picoliters including droplets approximately equal in size to those of the first layer, medium sized droplets, and small droplets. In some embodiments, the small droplets will comprise one half or more of the droplets of the second layer. In some embodiments, the large size droplets, such as droplets having approximately the same size as the droplets of the first layer, will comprise less than 25% of the second layer, such as about 0 to about 25% of the first layer, or about 1% to about 25% of the first layer, or about 5% to about 20% of the first layer. In addition, the saturation of the first layer may be different from that of the second layer. In some embodiments, the saturation of the first layer is greater than that of the second layer. For example, the first layer may have a saturation of between about 300 and 350 units, while the second layer may have a saturation of between about 250 and 300 units.

In some embodiments, the first layer of the base layer includes large droplets, such as droplets of between approximately 15 to approximately 30 picoliters per drop, or between approximately 18 to approximately 24 picoliters per drop, or between approximately 20 to approximately 22 picoliters per drop, such as about 21 picoliters per drop. Droplets of this size may penetrate wood fibers and fill cavities to create a better bond with the substrate. The second layer of the base layer may include a mix of relatively smaller droplets, in which small droplets may make up about ⅓ or more, or about ½ or more, or about 60% or more of the droplet mixture of the second layer. For example, the small droplets may make up between about 30% to about 90% of the droplets of the second layer, or between about 50% to about 95% of the droplets of the second layer, or between about 60%-90% of the droplets of the second layer. These small droplets may be less than 1/10 the size of the large droplets, such as the large droplets of the first layer and/or the second layer. For example, the small droplets may be between about 1/10 to about 1/20 of the size of the large droplets of the first layer. In some embodiments, the small droplets may be between about 0.5 and about 4 picoliters, or between about 1.0 and about 2.0 picoliters, or between about 1.2 and about 1.8 picoliters, or about 1.5 picoliters per drop. The droplets of the second layer of the base layer may improve ink saturation and may smooth out the surface of the first layer so that the signage layer, such as the 3D print build, has a very smooth surface, flat and chemically receptive to which to bond.

The base layer may be allowed to dry naturally or may be assisted in drying or setting such as through the application of heat and/or UV light. In some embodiments, the base layer may be set with the use of a UV lamp. A UV lamp may be selected having an output sufficient to cure the ink. In some embodiments, the UV lamp may be used at the highest setting of the lamp.

Figure 12:
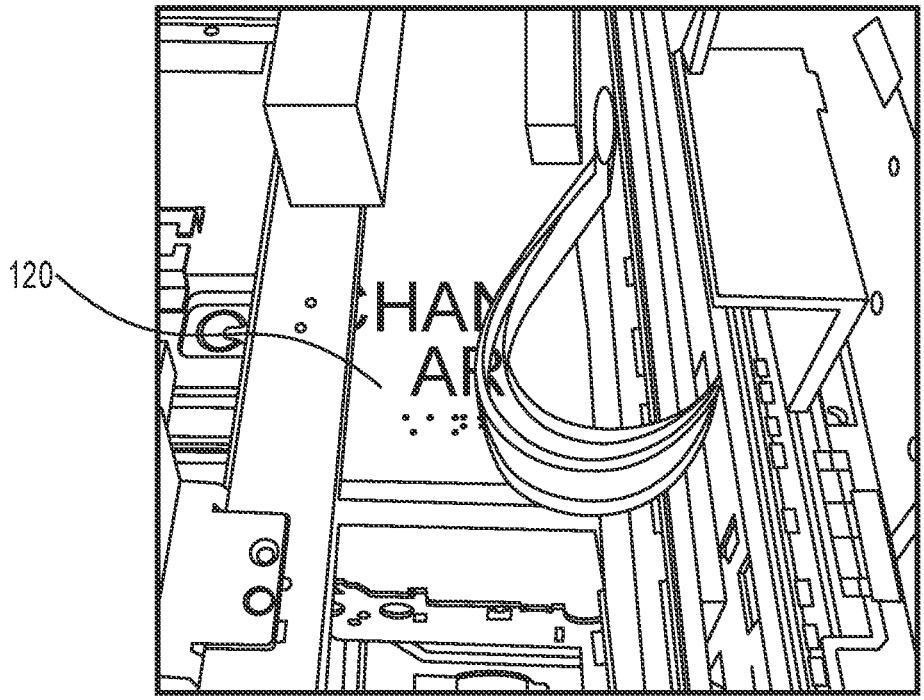
FIG. 12 illustrates a thin layer of clear ink bonding with a wood substrate prior to building of the print layer, in accordance with one embodiment.

FIG. 12 illustrates a wood substrate 120 onto which a thin layer of clear ink is being applied. The clear ink bonds with the wood substrate 120 prior to building of the signage layer, in accordance with one embodiment. The use of the micro layers of ink as the base layer may prevent the oils and saps from flowing and forming cavities during the heat process of creating the signage layer which cause defects in the signage layer as described above. Applying a base layer in the form of micro layers of ink that penetrate and bond into the wood fibers, then cool, it prevents this problem by allowing the build to start from a more level base by distributing heat and time exposure into the substrate more efficiently.

When the substrate is made of a material other than wood, the preparation of the substrate may vary depending upon the particular substrate and the nature of its surface. For example, for metal substrates such as aluminum, and for glass substrates, the substrate may already be sufficiently flat. However, the substrate may need to be carefully cleaned. Whatever the substrate, the preparation should make the substrate very flat and clean prior to printing the base layer and/or the signage layer. In all cases, a base layer may be applied to the substrate prior to the signage layer to improve the final sign.

After the application of the base layer, the signage layer may be applied to the print surface. In certain embodiments, a 3D printer such as a UV printer having 3D printing capabilities may be used to print the signage layer. In some embodiments, it may be useful for the 3D ink to have a micro-fine finish so that braille, letters, and pictograms are smooth and do not need secondary processing. It may also be useful for the ink to have the ability to bond with the selected substrate, as opposed to a 3D ink used to build a standalone project. Accordingly, in some embodiments, the signage layer may be printed using a printer including liquid ink injectors and UV curing. For example, the printer may dispense the ink from piezo injectors and may then set the ink using a UV curing process. The steps of ink injection and curing may be performed once for a single layer and single color, or may be repeated multiple times for multiple layers and/or colors.

The step of printing or building the signage layer may be done to a suitable height with suitable color ink. In some embodiments, OTS inks may be used. In some embodiments, the signage layer may be built as primarily a clear layer with color being layered at the end. In some embodiments, the inks may be customized to alter various aspects of the signage output such as vibrancy, brightness, shininess, etc. Customization may be done by supplementing the base ink with other inks or substances to enhance the desired properties.

In accordance with various embodiments, the signage layer may include raised content and/or the signage layer may be built to at least approximately 1/32" above the substrate or base layer. It may be desirable for the color of pictograms and letters to have a strong contrast to the background.

Depending upon the particular printer used, the process of printing the sign face, including the base layer and the signage layer, may include the following steps. The substrate may be aligned on a printing bed in an appropriate location and orientation for receiving the planned printing which may be provided by a computerized output file, for example. The print head height may set directly to the substrate. Using 3D printing, the printing bed may move relative to the print head. In some embodiments, it may be useful to keep the substrate stationary as the printing bed moves. A sticky mat may be laid under the substrate, between the substrate and the printing bed, in order to keep the sign blank stationary on the printing bed.

An alignment tool may be used to ensure alignment of the sign blank on the printing bed. In some embodiments, the 0, 0 (aka X, Y origin coordinate) point may be the start point, such as for many computer-numerically controlled (CNC) routers, lasers, 3D printers, inkjet printers and similar devices that work a piece of material. The start point may be the upper left hand corner. Instructions sent to the machine may reference a single coordinate (e.g., 1323, 707) and instruct the output device to perform some action at that given coordinate. For CNC operations the machine may have values for the full range of motion on an output device. As such, in day to day use, one part of the table is used more than other parts.

The alignment tool may comprise a table having pockets that push each substrate into what is effectively a new 0, 0 for each piece. The output file may correspond to this but have one single output file able to create many different and unique pieces with super-accurate registration. In this way it may provide faster total output times with no sacrifice of quality.

After printing of the signage layer, the sign may be evaluated for generally uniform color and height. The sign may also be inspected for defects such as running of the ink, explosions, collapses, or contamination caught in build. The color may be inspected for proper color output and banding, for example.

A protective layer, such as a clear eco-friendly material, may optionally be applied over the signage layer. Such protective layer may be a thin layer of food safe biodegradable wood oil applied via a hand sprayer, for example. In such embodiments, the wood oil may bring out the grain of the wood and provide a level of protection to the wood surface. The protective layer may be applied to the sign face and edges. If oil is used as the protective layer, excess oil may be removed, for example, using a microfiber cloth. In some embodiments it may be useful to avoid application of a protective layer comprising oil to the back of the sign as this may interfere with sign installation, though in other embodiments a protective layer may be applied to the back of the sign.

Figure 13:
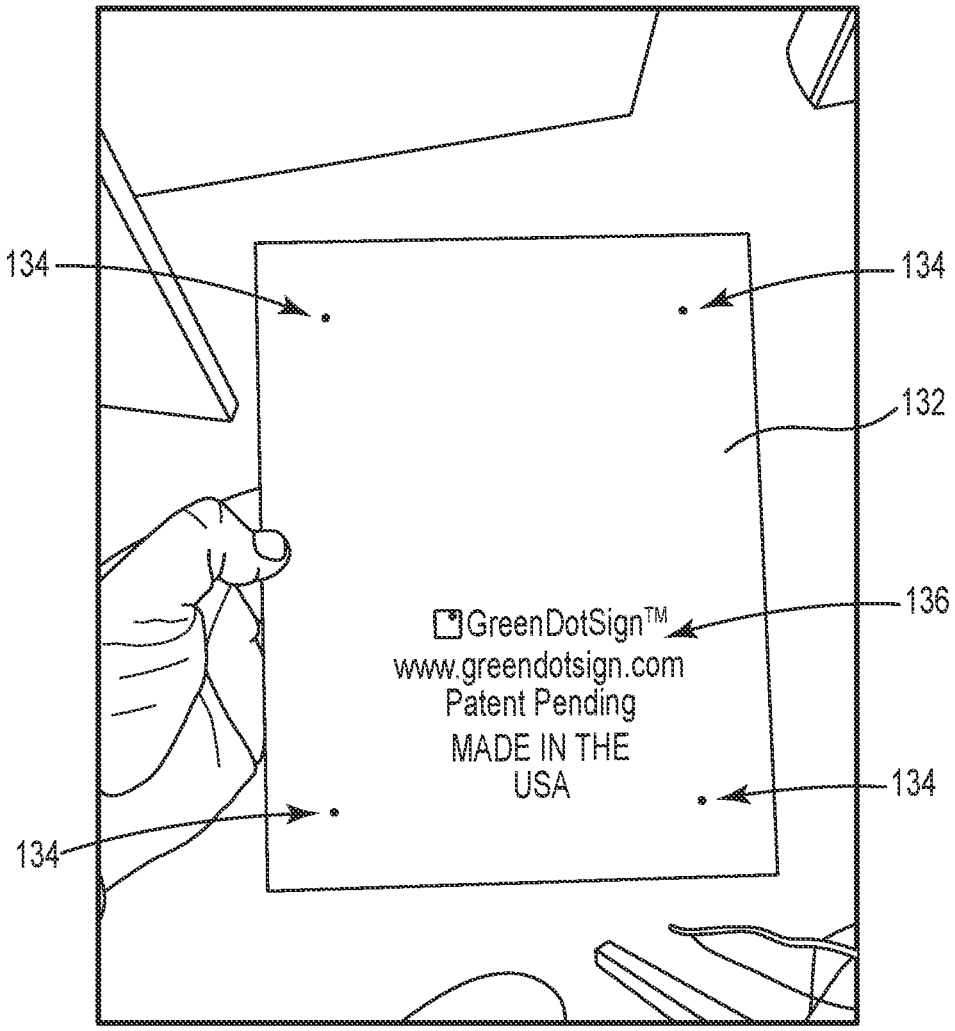
FIG. 13 illustrates an example layout for installation dots, in one embodiment.

In addition to the steps discussed above, in some embodiments, the method of making the sign may optionally include the placement of installation dots which may be printed on the back side of the substrate. For example, four dots may be applied to the back side of the substrate. These installation dots may work as guides or registration marks for installation options. Contact or branding information may also optionally be applied to the back of the substrate. In general, any suitable method for printing may be used on the back of the substrate. This may include, for example, printing using a UV printer or a rubber pad stamp. FIG. 13 illustrates an example of a substrate 130 showing the back surface 132 which includes four installation dots 1304 as well as printed product source information 136.

An example of the steps for printing a sign having raised content and braille according to various embodiments are illustrated in FIG. 14. The specific steps may vary depending upon the type of printer used and other details. In this example, an output file may be designed for printing the sign face using the appropriate software for the printer. The output file may be designed to comply with standard ADA build in instructions.

Once completed as described above, the eco-friendly sign may be installed at the location where the sign is to be displayed. Any suitable method may be used for installing the sign. Two methods are discussed here as examples.

In a first installation method, also referred to as traditional installation, foam tape may be applied to the back of the sign. For example, foam tape may be applied as a horizontal top strip and a horizontal bottom strip, the top strip running between two top points and the bottom strip running between two bottom points. In an alternative embodiment, the foam tape may be run as an L shape on the back of the sign. The intended location of the sign on the wall may be measured. An adhesive such as an eco-friendly silicon may be applied to the wall. In some embodiments, the eco-friendly silicon may be applied in a circle. The sign may then be pressed against the wall until affixed. In some embodiments, this may comprise applying pressure to the sign for 10 minutes.

A second installation method, also referred to as 4-peg installation, may be useful for rough walls. In an example embodiment, ¼ inch holes may be drilled into the back of the sign at a depth of ⅜ inch using a forstner drill bit. Dowels may be inserted into the drilled holes and set with eco-friendly adhesive, such as wood glue. Paper patterns may be provided with points matching points on the sign such that the pattern can be taped to the wall and holes drilled through the paper at appropriate locations. The pattern in the size of the sign may be taped on the wall at the desired location. Holes may be drilled into the wall for receiving the dowels. The pattern taped on the wall may then be removed. An adhesive, such as an eco-friendly silicone, may be applied to each of the dowel ends and then the dowels may inserted into the wall.

Figure 15:
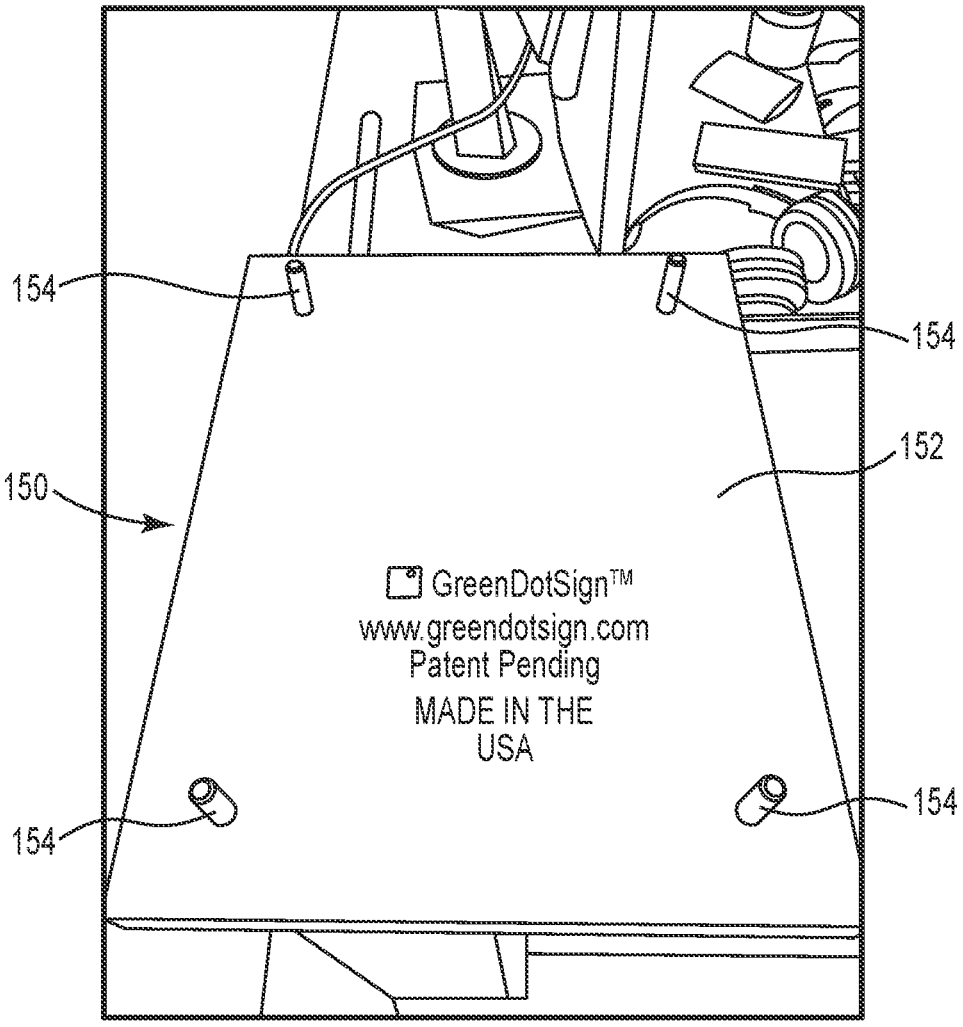
FIG. 15 illustrates dowels positioned on a sign for installation using a 4-peg installation method, in accordance with one embodiment.

FIG. 15 illustrates a sign substrate 150 having a back surface 152. Four dowels 154 are positioned on the back surface 152 for installation using a 4-peg installation method, in accordance with various embodiments.

Various embodiments are environmentally friendly such that they may qualify for various certifications such as LEED credits. For example, the signs may comply with the FSC® rules regarding chain of custody. For example, the sign material such as wood like aspen may be grown on FSC certified land. The sign material may also be processed by FSC compliant companies in processes such as kiln drying and formation into boards in the case of wood. As such, the material may be tracked back to its source and is FSC compliant throughout its life prior to production into an ecologically friendly sign. FSC rules are ecologically rigorous forest management certifications which contribute to LEED, such as through MR: BPDO—Sourcing Raw Materials Option 2. Compliance with such regulations make these signs unique as registered environmentally friendly products. In addition, some embodiments described herein are published in the Health Product Declaration (HPD) in which the constituents are detailed to 100 PPM. In this way, various embodiments contribute to MR: BPDO—Material Ingredients, Option 1, which is also believed to be unique in the sign industry.

To further enhance the environmentally responsible nature of various embodiments described herein, the signs may be repurposed. For example, when a sign is no longer needed, the raised elements of the sign may be planed off and disposed of. The remaining board may then be ground into wood fibers which may be used for various purposes such as animal bedding, fertilizer or dirt. This reuse of the signs qualifies for further LEED credit under MR: Responsible Sourcing of Raw Materials, and the embodiments described herein are believed to be unique among signs in the industry as qualifying for LEED credits in this way.

Experimental

Due to the difficulties of working with eco-friendly materials and 3D printing, preliminary efforts to apply 3D printing to wood substrates resulted in a high failure rate in which the final product was not acceptable under ADA standards for various reasons. Initial efforts at producing ADA compliant eco-friendly signs results in a failure rate of over 50%. However, through the use of the methods described herein, the failure rate was dramatically reduced to approximately 2%, varying between about 0.5% for lettering and 8% for pictograms. This compares favorably with the failure rate for traditional routed plastic ADA signs, which is estimated to be approximately 15%-25%, with approximately 5%-10% being not salvageable even with additional work.

During development of the processes described herein, three dimensional ADA compliant eco-friendly signs and sign remnants were tested using the following techniques to test their durability. Before testing as described below, these signs were first visually inspected for defects such as ink running into the wood fibers. The pieces which passed visual inspection were tested as describe below.

Chemical testing was performed by spraying cleaning products on the signs, wipe them off, observing and repeating.

Environmental testing was performed by submerging the signs in water, removing them, and then freezing them while damp.

Temperature cycling testing was performed by placing the signs in a room temperature environment, then in an environment below the freezing temperature of water, then back in a room temperature environment, then back in a freezing environment.

The signs were tested for temporal durability by placing them on a window ledge for more than three years.

The signs were tested for mechanical strength by scraping the finished print surface and signage with a fingernail to attempt to scrape of the raised features.

In most cases if the bond was bad, during a test or immediately upon mechanical strength testing it would fail. However, in the case of glass it was temporal testing that showed failures. After the experiment was run, the piece was inspected for visual defects and then mechanically tested, both of which were pass/fail tests. Based on the results of these tests on various pieces produced with various methods, the processes described in this application were developed in order to provide effective and durable products.

In the foregoing description various embodiments of the invention have been presented for the purpose of illustration and description. They are not intended to be exhaustive or to limit the invention to the precise form disclosed. Obvious modifications or variations are possible in light of the above teachings. The embodiments were chosen and described to provide the best illustration of the principals of the invention and its practical application, and to enable one of ordinary skill in the art to utilize the invention in various embodiments and with various modifications as are suited to the particular use contemplated. All such modifications and variations are within the scope of the invention as determined by the appended claims when interpreted in accordance with the breadth they are fairly, legally, and equitably entitled.

What is claimed is:

1. An eco-friendly sign produced by the method comprising:

selecting a substrate as a base material, the substrate having a first planar surface and an opposing second planar surface;

cutting the substrate to a sign dimension;

treating the first planar surface to form a smooth print surface;

applying a base layer to the print surface;

applying a signage layer onto the base layer; and cleaning the substrate after treating the first planar surface and prior to applying the clear ink base coat.

2. The eco-friendly sign of claim 1 wherein cleaning the substrate comprises applying a vacuum to the first planar surface of the substrate.

3. The eco-friendly sign of claim 2 wherein applying a vacuum to the first planar surface of the substrate comprises inserting the substrate into a vacuum device.

4. An eco-friendly sign produced by the method comprising:

selecting an aspen wood as a substrate for a base material, the substrate having a first planar surface and an opposing second planar surface;

cutting the substrate to a sign dimension;

treating the first planar surface to form a smooth print surface;

applying a base layer to the print surface;

applying a signage layer onto the base layer.

5. An eco-friendly sign produced by the method comprising:

selecting a wood substrate as a base material, the substrate having a first planar surface and an opposing second planar surface;

cutting the substrate to a sign dimension;

sanding the first planar surface to form a smooth print surface;

applying a base layer of at least two layers of clear ink to the print surface using a 3-dimensional printer, wherein droplets of the second layer of at least two layers include small droplets which are about 1/10 or less of the size of the droplets of a first layer of at least two layers;

applying a 3-dimensional signage layer onto the base layer;

wherein the eco-friendly sign is compliant with ADA regulations.

* * * * *